US007896461B2

(12) United States Patent
Tsukada

(10) Patent No.: US 7,896,461 B2
(45) Date of Patent: Mar. 1, 2011

(54) FLUID DISCHARGE DEVICE, AND A PRINTER AND MEDIA PROCESSING DEVICE THAT USE THE FLUID DISCHARGE DEVICE

(75) Inventor: Satoshi Tsukada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 184 days.

(21) Appl. No.: 12/380,794

(22) Filed: Mar. 4, 2009

(65) Prior Publication Data

US 2009/0225134 A1 Sep. 10, 2009

(30) Foreign Application Priority Data

Mar. 4, 2008 (JP) ..... 2008-053700

(51) Int. Cl.
*B41J 2/165* (2006.01)
*B41J 2/135* (2006.01)

(52) U.S. Cl. ..... 347/29; 347/32; 347/45

(58) Field of Classification Search ..... 347/29, 347/45, 32

See application file for complete search history.

(56) References Cited

U.S. PATENT DOCUMENTS 5,602,573 A * 2/1997 Waschhauser et al. ..... 347/33
6,641,248 B2 11/2003 Mitsui et al.
2006/0232622 A1 10/2006 Nishihara et al.

FOREIGN PATENT DOCUMENTS

JP 2002-264351 9/2002
JP 2004-034660 2/2004
JP 2006-264243 10/2006

OTHER PUBLICATIONS

"Surface Finishing from Ra to Rz" by Ryan Bourget, Apr. 2003.*

* cited by examiner

*Primary Examiner* — Shih-wen Hsieh
(74) *Attorney, Agent, or Firm* — Nutter McClennen & Fish LLP; John J. Penny, V; Christopher J. Stow

(57) ABSTRACT

A fluid discharge device suppresses discharge defects caused by adhesion of fluid spray and maintains a good fluid discharge condition. A printer and a media processing device include the fluid discharge device. An inkjet head has ink nozzles for discharging ink. A box-shaped head cap 82 has an opening that can seal the nozzle surface to which the ink nozzles of the inkjet head are disposed. The head cap 82 has a lip 92 that can contact the nozzle surface. The lip 92 has an inside slope 93 and an outside slope 94 that incline gradually toward the nozzle surface to a point when seen in cross section. The inside slope 93 of the lip 92 is rendered as a smooth part 93*a* with lower surface roughness than a coarse part 94*b* rendered on the outside slope 94.

7 Claims, 12 Drawing Sheets

○: Ink does not migrate (up) along the inside slope 93

△: Ink can sometimes migrate up along the inside slope 93 to the peak.

×: Ink can migrate along the inside slope 93 to the peak.

| SURFACE ROUGHNESS OF LIP | 2.2 | 2.4 | 2.8 | 3.2 | 3.6 | 4 | 4.3 |
|---|---|---|---|---|---|---|---|
| CONDITION OF INK ON THE INSIDE SLOPE | ○ | ○ | ○ | ○ | △ | △ | × |

FIG. 11

FLUID DISCHARGE DEVICE, AND A PRINTER AND MEDIA PROCESSING DEVICE THAT USE THE FLUID DISCHARGE DEVICE

BACKGROUND OF THE INVENTION

1. Field of Invention

The present invention relates to a fluid discharge device that discharges fluid from the nozzles of a discharge head, and to a printer and a media processing device that use the fluid discharge device.

2. Description of Related Art

Printers such as inkjet printers typically print by the print head discharging ink droplets from a plurality of nozzles.

Such printers may also have a pumping device that seals the nozzle surface of the print head with a cap and vacuums ink from the nozzles in order to unclog clogged nozzles in the print head, or a capping device that seals the nozzle surface of the print head with a cap when not printing (when in the standby mode) in order to prevent the nozzles of the print head from becoming clogged. See, for example, Japanese Unexamined Patent Appl. Pub. JP-A-2006-264243.

The surface tension of the ink that is absorbed by a sponge or other absorbent material disposed inside the cap may, however, cause the ink to travel over the inside surface of the cap to an area that comes in contact with the nozzle surface. If the ink I transferred from the absorbent material 95 inside the head cap 82 travels to an area in contact with the nozzle surface 61*a* as shown in FIG. 12A, a film of ink I is formed between the lip 92 of the cap and the nozzle surface 61*a* the moment the head cap 82 separates from the nozzle surface 61*a* as shown in FIG. 12B. When this film then breaks, the ink I is scattered and ink droplets cling to the nozzle surface 61*a* as shown in FIG. 12C. More particularly, because the space inside the head cap 82 is in a vacuum state when the head cap 82 separates from the nozzle surface 61*a,* the film of ink I explodes into the head cap 82, and the ink I spray easily clings to the ink nozzles of the nozzle surface 61*a*. When ink I thus clings to an ink nozzle, it breaks the ink meniscus inside the ink nozzle and causes ink discharge problems.

SUMMARY OF THE INVENTION

A first aspect of the invention is a fluid discharge device that can suppress discharge defects caused by the adhesion of fluid spray and maintain a good fluid discharge state. A printer and a media processing device according to the present invention have this fluid discharge device.

A fluid discharge device according to a first aspect of the invention has a discharge head that has a discharge nozzle for discharging fluid, and a head cap that has an opening that can seal a nozzle surface to which the discharge nozzle of the discharge head is disposed and can contact the nozzle surface so that the discharge nozzle is covered. The fluid discharge device is rendered so that the head cap can move to and away from the nozzle surface. The head cap has a lip part that has a contact portion that contacts the nozzle surface, and the inside circumference surface of the lip part is formed with a centerline average surface roughness Ra of 3.2 or less.

Because the centerline average surface roughness Ra of the inside surface of the head cap is less than or equal to access door 3.2, it is difficult for fluid on the head cap to migrate over the inside surface of the head cap. As a result, when the head cap is placed tightly to the nozzle surface of the discharge head, fluid can be substantially prevented from migrating along the lip part and contacting the portion in contact with the nozzle surface.

Preferably, the contact portion and outside circumference surface of the lip part are formed with a centerline average surface roughness Ra of 3.2 or less. By thus rendering the contact portion and the outside surface of the lip part as smooth surfaces, accumulation of fluid at the smooth part is suppressed, fluid at the contact portion moves easily down, and adhesion of fluid to the contact portion can be completely or substantially eliminated. This aspect of the invention is further preferable because even if fluid sticks to the outside surface, it is difficult for the fluid to migrate to the contact portion.

In a fluid discharge device according to another aspect of the invention, a coarse part with coarser surface roughness than the surface roughness of the contact portion is formed to the lip part at a part of the outside circumference surface separated from the contact portion. Even if some fluid is left in the contact area between the lip part of the head cap and the nozzle surface, the induction of fluid to the coarse part can be effectively promoted, and when the head cap separates from the nozzle surface, any residual fluid is pulled by the effect of surface tension to the coarse part of the outside surface. Leaving fluid in the contact portion of the lip part can thus be prevented, production of fluid spray can be eliminated when the head cap separates from the nozzle surface, discharge defects caused by fluid adhering to the nozzle surface can be prevented, and a good fluid discharge state can be maintained.

Further preferably, the fluid discharge device according to another aspect of the invention has the inside circumference surface of the lip part is formed with an inside slope that tapers with gradually decreasing wall thickness toward the peak part of the contact portion to a point when seen in section, and the outside circumference surface of the lip part is formed with an outside slope that tapers with gradually decreasing wall thickness toward the peak part of the contact portion to a point when seen in section. This aspect of the invention is preferable because the contact portion is compressed with the peak rendered by both slope parts being pushed in, and fluid left at the contact part therefore does not scatter.

In a fluid discharge device according to another aspect of the invention the smooth parts are formed by reducing the surface roughness of the die used to mold the lip part.

With the fluid discharge device according to another aspect of the invention the smooth parts of the lip part can be easily formed by reducing the surface roughness of the die used to mold the lip part, and adhesion of fluid on the discharge nozzle can be suppressed at low cost.

Another aspect of the invention is a printer that has the fluid discharge device of the invention and prints on a print medium by discharging ink droplets from the discharge nozzle.

The reliability of ink discharge from the ink nozzles of a printer according to this aspect of the invention is high, and high quality printing can thus be assured.

Another aspect of the invention is a media processing device that applies an information process to flat media, and has the printer according to the present invention for printing on the media.

The media processing device according to this aspect of the invention can print with high quality on the label side of flat print media such as CDs and DVDS.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 11 is a table describing the relationship between the surface roughness of the lip and the condition of ink.

DESCRIPTION OF PREFERRED EMBODIMENTS

A preferred embodiment of a fluid discharge device, a printer, and a media processing device according to the present invention is described below with reference to the accompanying figures.

The media processing device of the invention is described below using a disc publisher by way of example.

Figure 1:
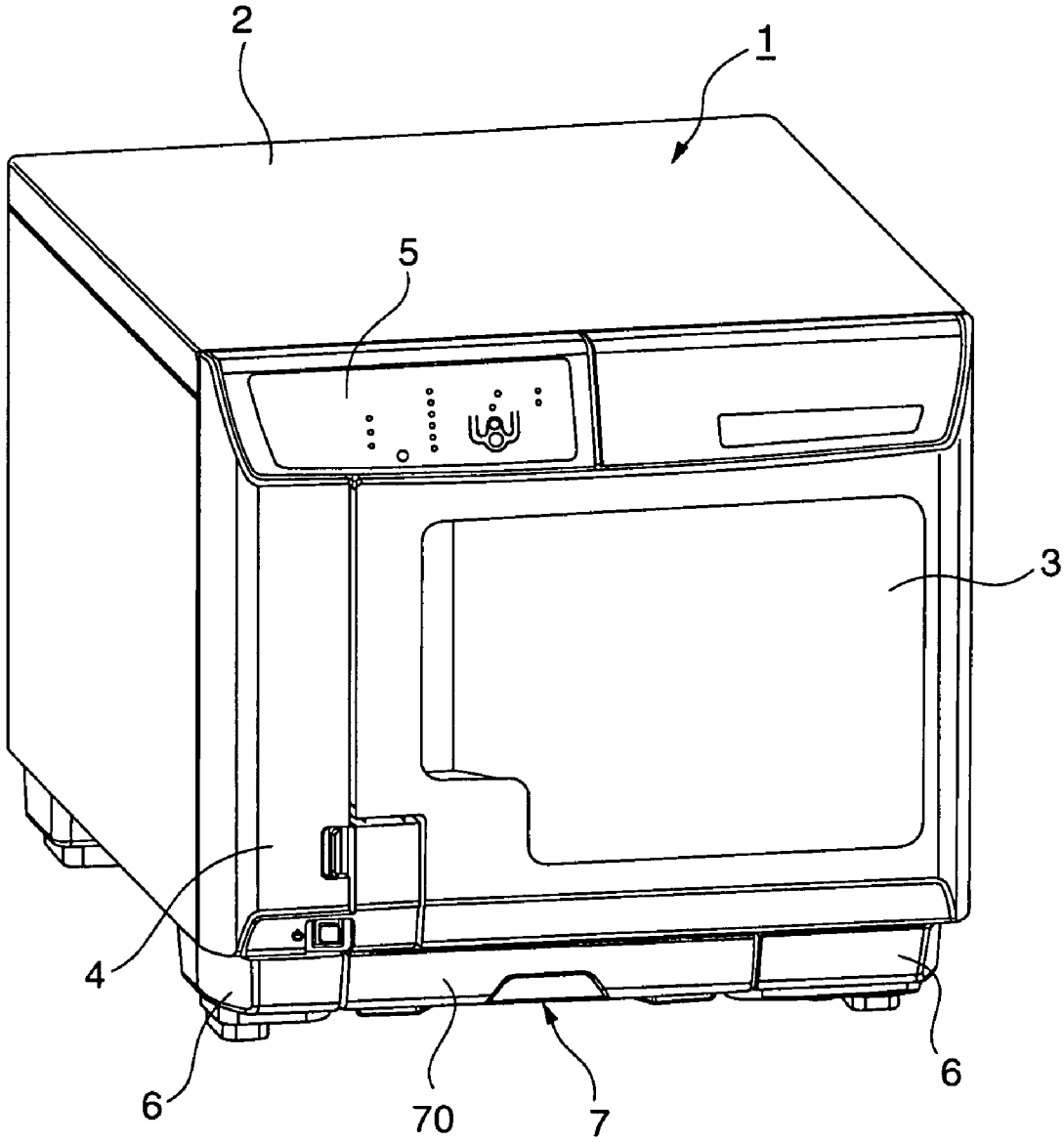
FIG. 1 is an external oblique view of a media processing device (publisher) according to the present invention.
Figure 2:
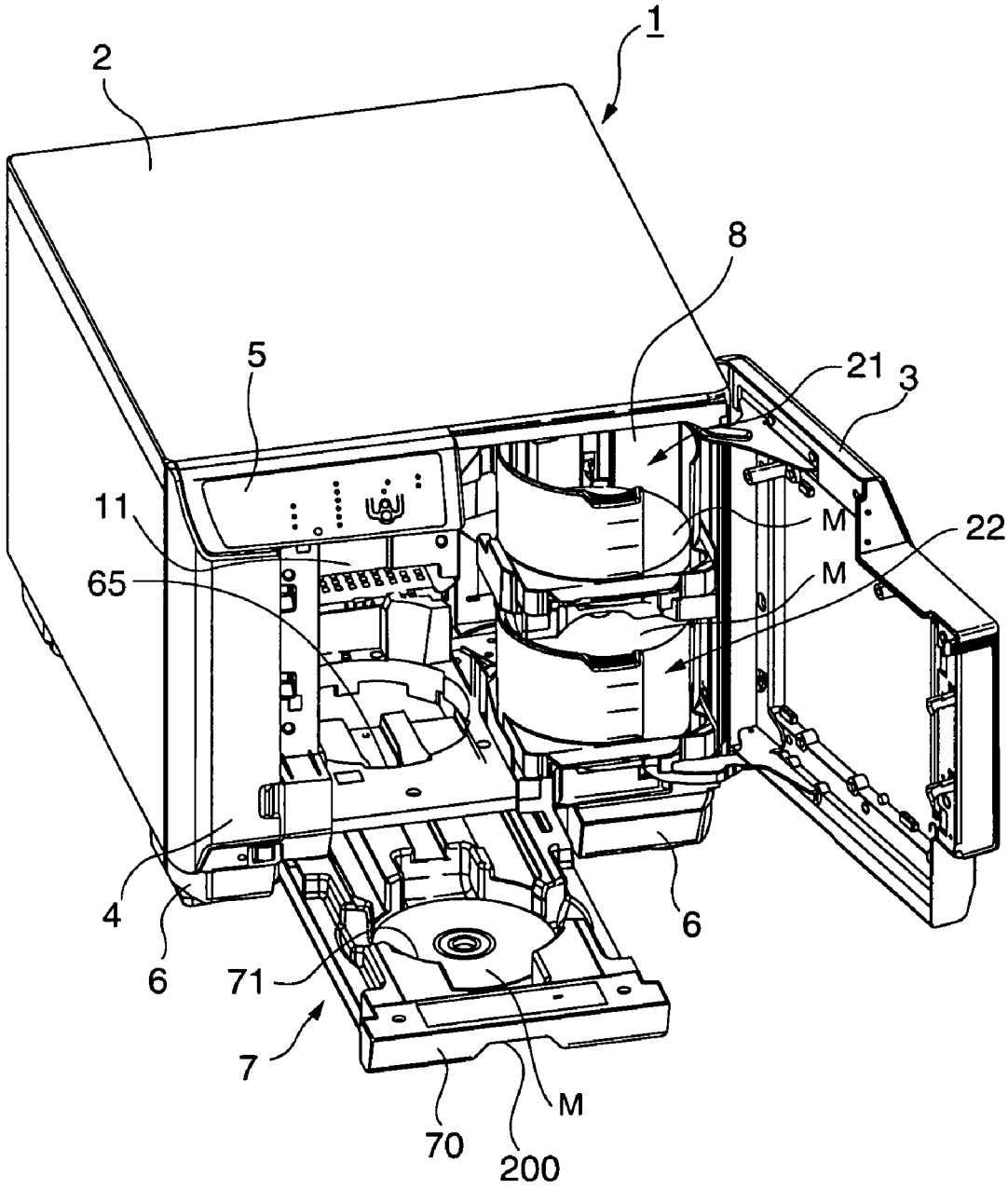
FIG. 2 is an oblique view from the front of the publisher shown in FIG. 1 with the front access covers open.
Figure 3:
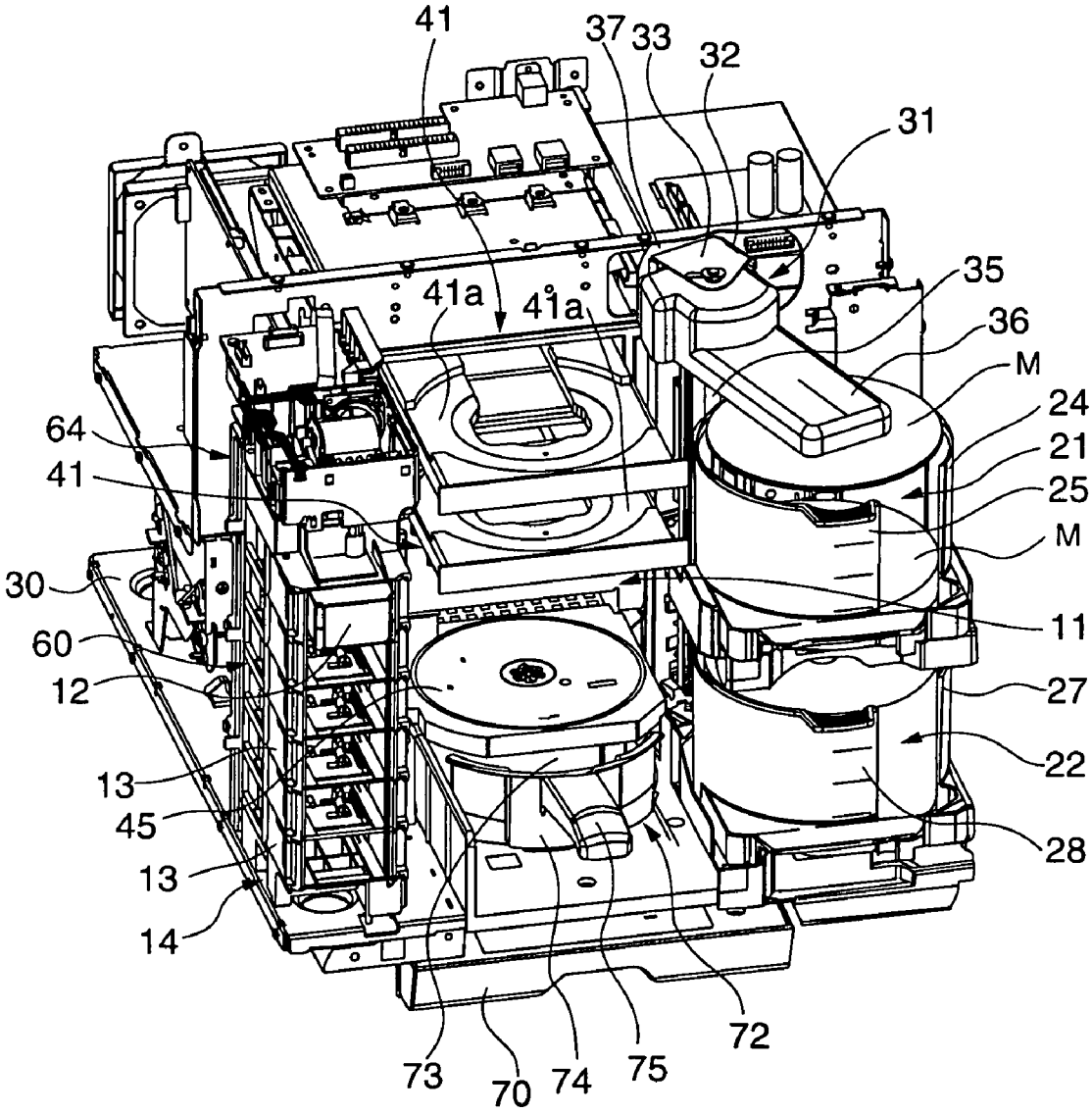
FIG. 3 is an oblique view from the front [back?] of the publisher in FIG. 1 with the case removed.
Figure 4:
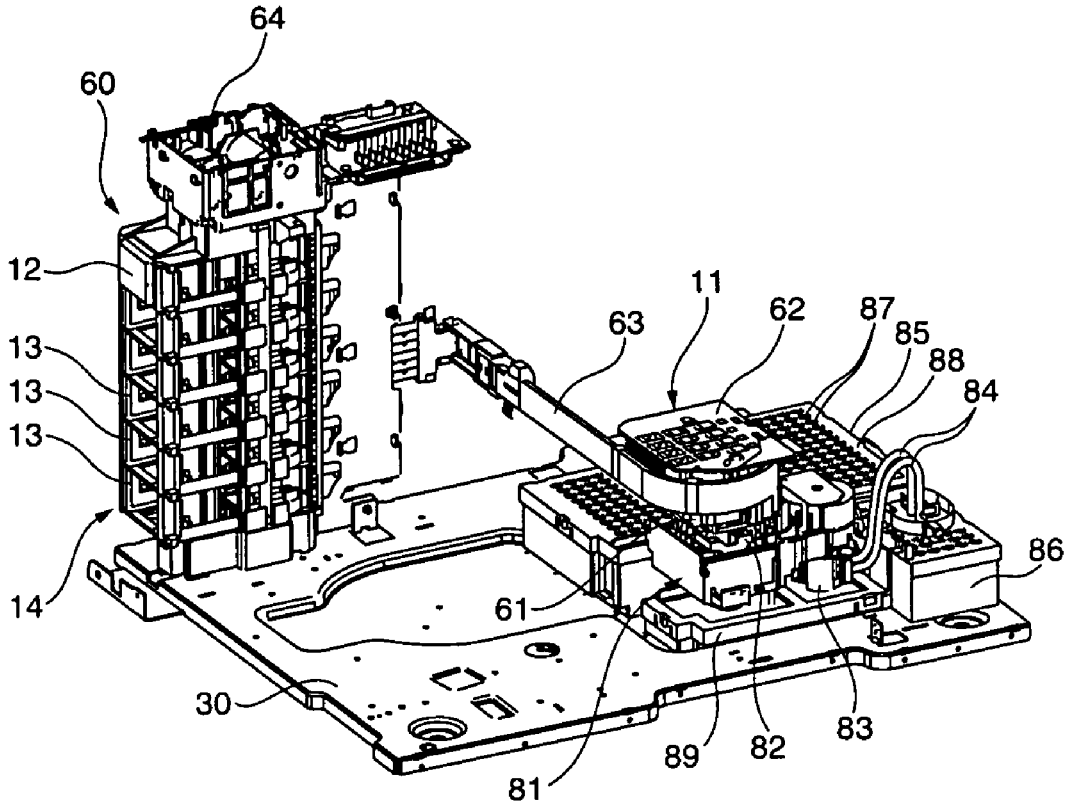
FIG. 4 is an oblique view of the label printer assembly disposed in the publisher in FIG. 1.
Figure 5:
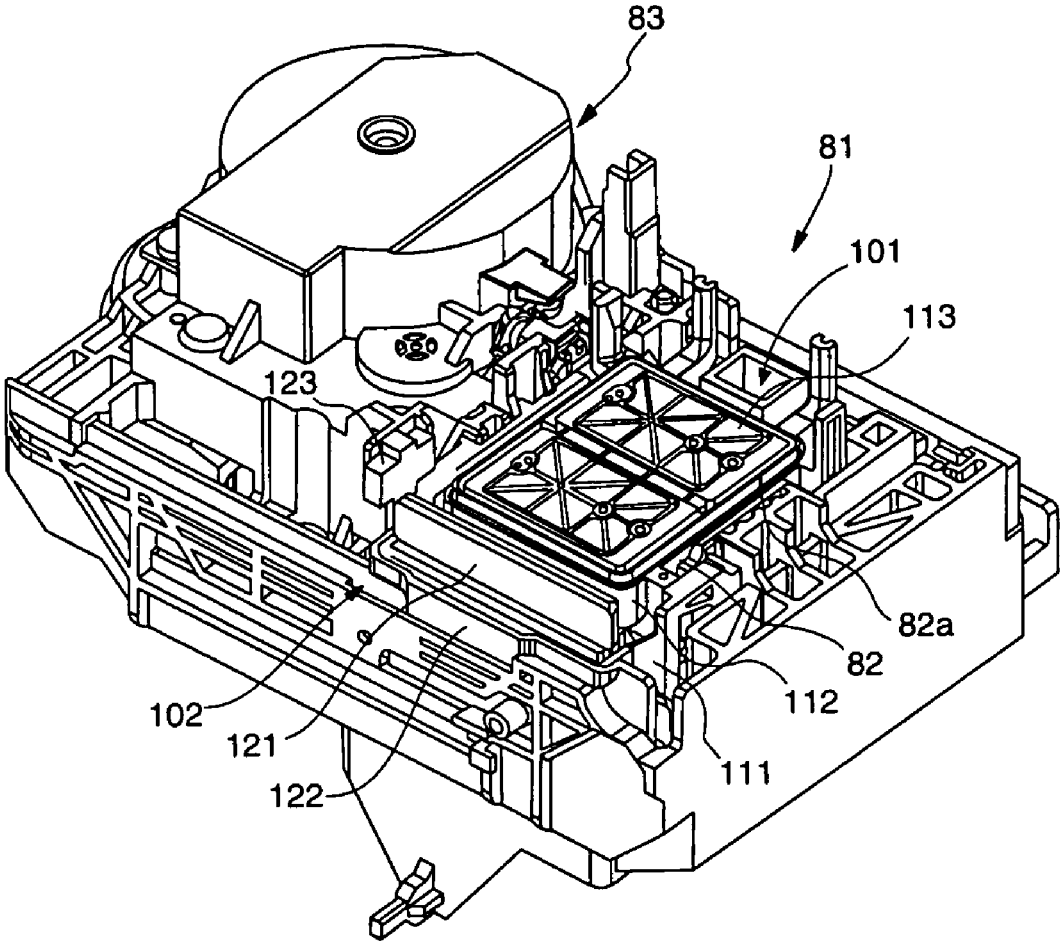
FIG. 5 is an oblique view describing the structure of the head maintenance mechanism in the printer shown in FIG. 4.

FIG. 1 is an external oblique view of the publisher (media processing device) when all units are closed. FIG. 2 is an external oblique view of the publisher with the access doors and disc tray open. FIG. 3 is an oblique view from the top front side of the publisher with the case removed. FIG. 4 is an oblique view of the label printer assembly incorporated in the publisher. FIG. 5 is an oblique view describing the drive mechanism in the label printer unit.

As shown in FIG. 1, the publisher 1 is a media processing device that writes data to and/or reads data from, and prints on the label side of, disc-shaped media (data recording media) such as CDs and DVDs, and has a basically box-shaped case 2. Doors 3 and 4 that open and close to the right and left are attached at the front of the case 2. An operating panel 5 having various indicators and operating buttons is disposed at the top left part (left as seen from the front) of the case 2, and support legs 6 project down from the bottom of the case 2 on both right and left sides. A drawer mechanism 7 is disposed between the right and left legs 6.

As shown in FIG. 2, the access door 3 on the left side of the device (the right side as seen from the front) opens and closes for access to an open area 8 at the front of the publisher 1, and is a door that opens and closes for loading unused (blank) media M and removing finished media M from the open area 8.

The access door 4 on the right side of the device (the left side as seen from the front) opens and closes for replacing the ink cartridges 12 of the label printer 11 shown in FIG. 3. When the door 4 is open, a cartridge carrier unit 14 with a plurality of cartridge holders 13 arrayed in a vertical stack is exposed.

A media stacker 21 (media storage unit) for holding a plurality of unused blank discs M (such as 50) to which data has not been written in a vertical stack, and another media stacker 22 (media storage unit) for similarly holding a plurality of completed discs M or blank discs M (such as 50) are disposed inside the case 2 of the publisher 1. Media stacker 21 and media stacker 22 are disposed one above the other so that the media M are stored coaxially in the stackers. Both media stacker 21 and media stacker 22 can be freely installed to and removed from predetermined positions.

The top media stacker 21 has a pair of right and left curved side walls 24 and 25. The blank discs M are placed from the top into the blank media stacker 21 between the side walls 24 and 25, which hold the discs in a substantially coaxial stack. The task of storing or adding the blank discs M to the blank media stacker 21 can be done easily by opening the door 3 and pulling the media stacker 21 out.

The bottom media stacker 22 is identically constructed with a pair of right and left curved side walls 27 and 28, enabling the discs M to be inserted from the top and stored in a substantially coaxial stack.

A media transportation mechanism 31 is located behind the media stackers 21 and 22. The media transportation mechanism 31 has a vertical guide shaft 35 disposed between the main frame 30 and the top plate 33 of the chassis 32. A transportation arm 36 is supported so that it can move up and down and rotate on the vertical guide shaft 35. The transportation arm 36 can move vertically up and down along the vertical guide shaft 35 and can pivot right and left on the vertical guide shaft 35 by means of a drive motor 37.

Two media drives 41 are disposed one above the other at the back beside the two stackers 21 and 22 and the media transportation mechanism 31, and the carriage 62 (see FIG. 4) of the label printer 11 is disposed so that it can move below the media drives 41.

Each of the media drives 41 has a media tray 41*a*, which can move between a data writing position where data is recorded to the media M, and a media transfer position where the media M can be loaded and unloaded from the media tray 41*a*. The media drive 41 can read or write data to the media M on the media tray 41*a* when in the retracted position.

The label printer 11 also has a media tray 45 that can move between a printing position for printing a label on the label side of the media M, and a media transfer position where the media can be loaded and unloaded from the media tray 45.

FIG. 3 shows the media trays 41*a* of the top and bottom media drives 41 pulled out to the media transfer position, and the media tray 45 of the label printer 11 at the media transfer position.

The label printer 11 in this example is an inkjet printer that uses color ink cartridges 12 (for six colors, specifically, black, cyan, magenta, yellow, light cyan, and light magenta) as the ink supply mechanism 60. The ink cartridges 12 are installed from the front to the individual cartridge holders 13 of the cartridge carrier unit 14.

A space enabling the transportation arm 36 of the media transportation mechanism 31 to move up and down is formed between the pair of right and left side walls 24 and 25 of the one media stacker 21 and between the pair of right and left side walls 27 and 28 of the other media stacker 22. A space is also formed between the top and bottom media stackers 21 and 22 so that the transportation arm 36 of the media transportation mechanism 31 can pivot horizontally for positioning directly above the bottom media stacker 22. When media trays 41*a* are pushed into the media drives 41, the transportation arm 36 of the media transportation mechanism 31 descends and can access the media tray 45 of the label printer 11 at the media transfer position.

When both media trays 41*a* are in the data writing position and the media tray 45 for the label printer 11 is at the inside printing position, the transportation arm 36 of the media transportation mechanism 31 can descend below the height of the printer media tray 45. A guide hole 65 is formed below the media transfer position of the printer media tray 45. When the media transportation arm 36 descends to this position and releases a disc, the disc passes through the guide hole 65. A media stacker further described below can also be installed in this guide hole 65 (see FIG. 2).

The drawer mechanism 7 has a tray 70 disposed below the main frame 30 so that the tray 70 can slide closed inside the main frame 30 or pull out of the main frame 30 to open. The tray 70 has a recessed stacker unit 71. When the tray 70 is in the stored (closed) position, the stacker unit 71 is positioned below the guide hole 65, and the center of the stacker unit 71 is positioned with the center of the stacker unit 71 coaxial to the center axis of the media trays 41*a* and the printer media tray 45 in the media transfer position. The stacker unit 71 accepts media M guided thereinto by the guide hole 65, and stores a relatively small number of media M (such as 5 to 10). The stacker unit 71 accepts the media M from the top and stores the media M in a coaxial stack.

A media stacker 72 (removable media stacker) that can hold more media X than the stacker unit 71 is removably disposed in the guide hole 65 and tray 70 in the closed position (see FIG. 3). This media stacker 72 also has two curved side walls 73 and 74. Media M can be loaded from the open top between the side walls 73 and 74, and a plurality of media M (such as 50) can be stored coaxially in a stack between the side walls 73 and 74. A gap enabling the transportation arm 36 of the media transportation mechanism 31 to move up and down is also formed between the pair of curved side walls 73 and 74. A handle 75 that is held by the user when installing and removing the media stacker 72 is disposed at the top part of the one side wall 74.

When the media stacker 72 is installed, a blank disc M is taken from the bottom media stacker 22, written and printed by a media drive 41 and the label printer 11, and then deposited in the media stacker 72.

When both the top media stacker 21 and the bottom media stacker 22 are loaded to capacity (50+50 discs in this embodiment of the invention) with blank media M, all media M (50) in the bottom media stacker 22 are sequentially processed and stored in the media stacker 72, and all media M (50) in the top media stacker 21 are then sequentially processed and stored in the emptied bottom media stacker 22. This enables batch processing the maximum number of media M (50+50) that can be loaded in the top media stacker 21 and the bottom media stacker 22 in a single operation (the "batch processing mode").

If the media stacker 72 is removed, a blank disc M can be removed from the top media stacker 21 or the bottom media stacker 22, and can be stored in the stacker unit 71 of the tray 70 in the stored (closed) position after the disc is written and printed by the media drive 41 and label printer 11.

The completed media M can thus be removed from the stacker unit 71 by pulling the drawer tray 70 out. More specifically, completed media M can be sequentially removed one by one or plural discs at a time while processing other media M continues and the access door 3 remains closed. This is also referred to herein as the "external discharge mode."

The media M can thus be appropriately conveyed between the media stackers 21, 22, the stacker unit 71 (or media stacker 72) of the tray 70, the media trays 41*a* of the media drives 41, and the printer media tray 45 of the label printer 11 by moving the transportation arm 36 of the media transportation mechanism 31 in various ways up and down while pivoting right or left.

As shown in FIG. 4, the label printer 11 has a carriage 62 with an inkjet head 61 having nozzles (not shown in the figure) for discharging ink. The carriage 62 moves bidirectionally horizontally along a carriage guide shaft by means of the drive power from a carriage motor.

The label printer 11 has an ink supply mechanism 60 with a cartridge carrier unit 14 in which the ink cartridges 12 are installed. The ink supply mechanism 60 is vertically constructed and is attached perpendicularly to the main frame 30 of the publisher 1. One end of a flexible ink supply tube 63 is connected to the ink supply mechanism 60, and the other end of the ink supply tube 63 is connected to the carriage 62.

Ink in the ink cartridges 12 loaded in the ink supply mechanism 60 is supplied through the ink supply tube 63 to the carriage 62. The ink is supplied to the inkjet head 61 through the damper unit and back pressure adjustment unit (not shown in the figure) disposed to the carriage 62, and discharged from the ink nozzles (not shown in the figure).

A pressurizing mechanism 64 is disposed with the main part at the top of the ink supply mechanism 60, supplies compressed air to pressurize the inside of the ink cartridge 12 and expels ink from the ink pack in the ink cartridge 12.

A head maintenance mechanism 81 is disposed below the home position (shown in FIG. 4) of the carriage 62.

The head maintenance mechanism 81 has a head cap 82 and a waste ink suction pump 83. The head cap 82 covers the ink nozzles of the inkjet head 61 exposed below the carriage 62 in the home position. The waste ink suction pump 83 vacuums ink discharged into the head cap 82 by the ink charging operation and the head cleaning operation of the inkjet head 61.

Ink that is removed by the waste ink suction pump 83 of the head maintenance mechanism 81 is discharged through another tube 84 into the waste ink absorption tank 85. This waste ink absorption tank 85 is an absorption member not shown that is disposed inside the case 86, and has a cover 88 with numerous ventilation holes 87.

A waste ink catch pan 89 that is a part of the waste ink absorption tank 85 is disposed below the head maintenance mechanism 81 to catch and absorb ink that drips from the head maintenance mechanism 81 with an absorbent material.

The head maintenance mechanism 81 is described next.

Figure 6:
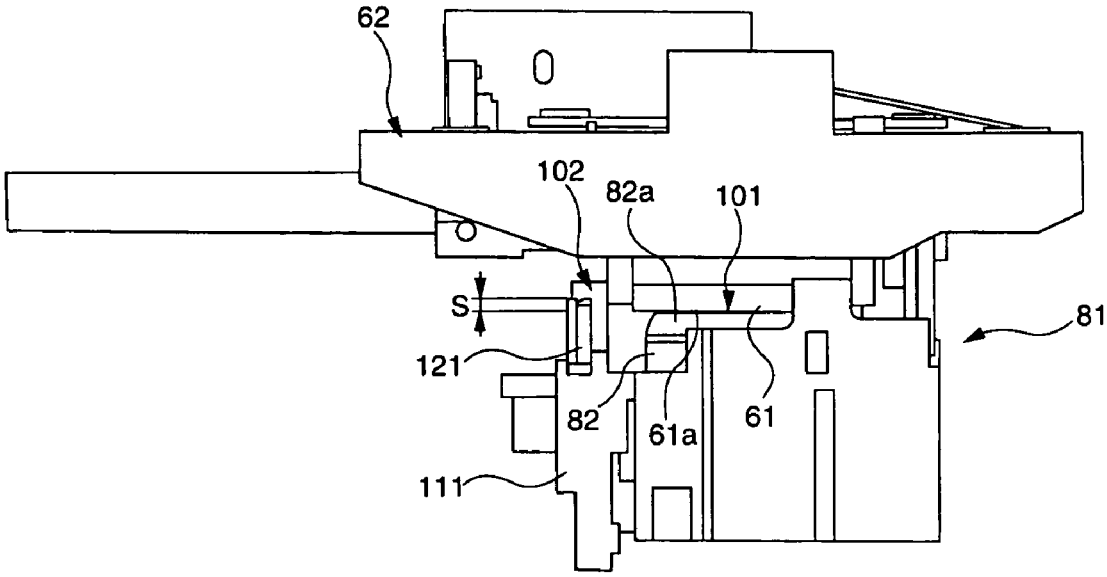
FIG. 6 is a front view describing the structure of the head maintenance mechanism in the printer shown in FIG. 4.
Figure 7A:
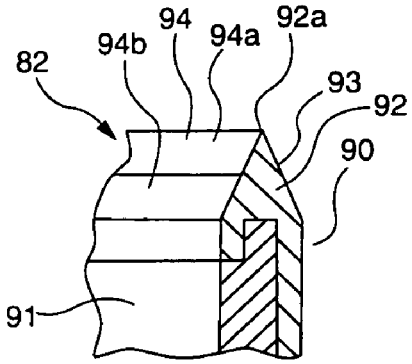
FIG. 7 shows a portion of the head cap shown in FIG. 5, FIG. 7A being an external section view of the head cap shown partially in section, and FIG. 7B being an section view, seen from inside the head cap shown partially in section.
Figure 7B:
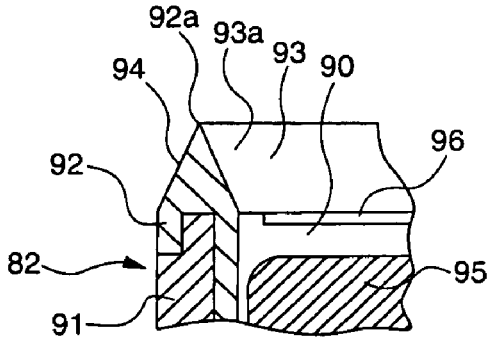
Figure 8:
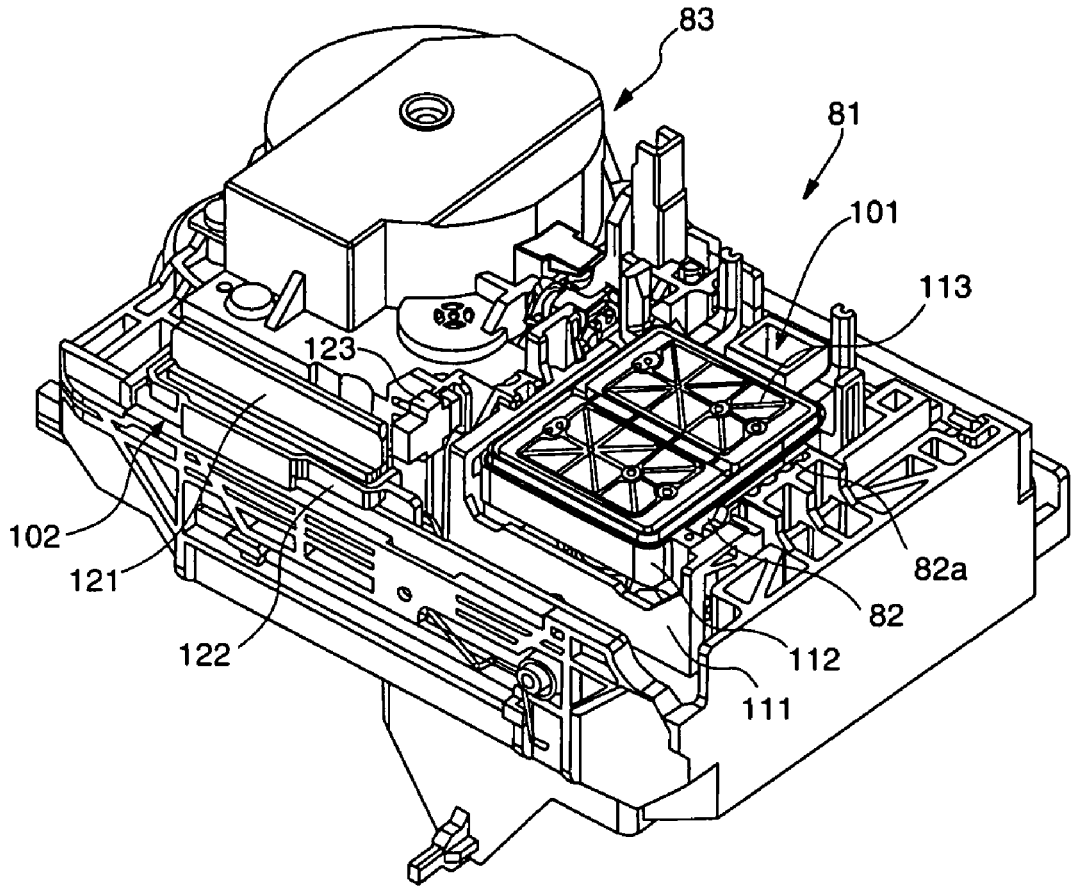
FIG. 8 is an oblique view describing operation of the head maintenance mechanism in the printer shown in FIG. 4.
Figure 9:
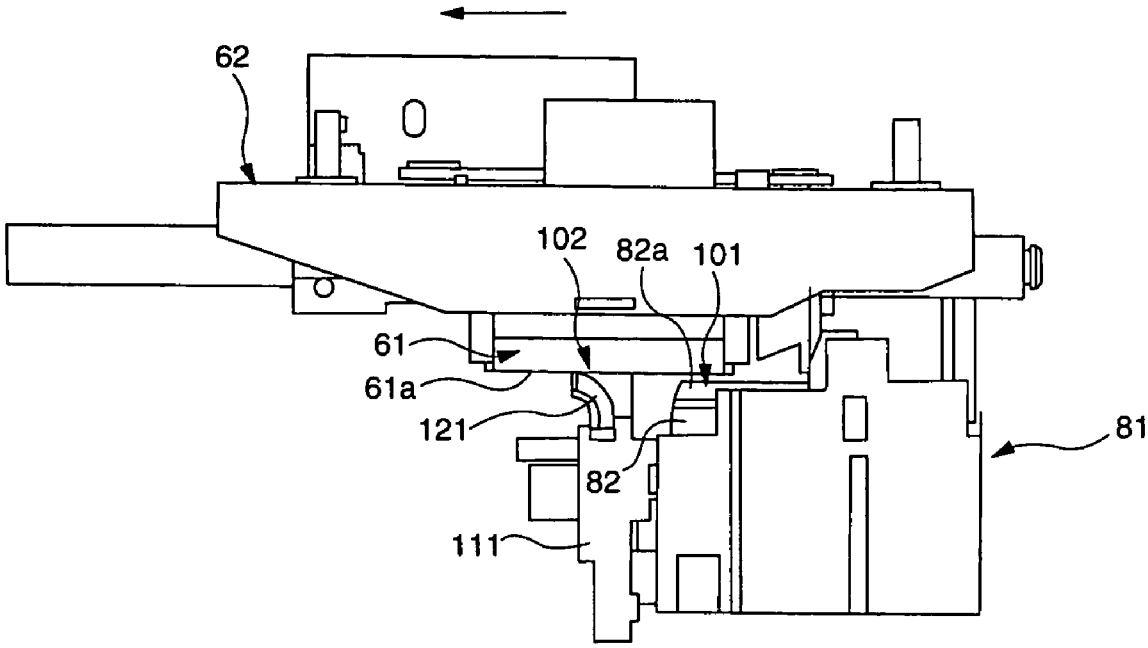
FIG. 9 is a front view describing operation of the head maintenance mechanism in the printer shown in FIG. 4.

FIG. 5 is an oblique view describing the structure of the head maintenance mechanism, and FIG. 6 is a front view describing the structure of the head maintenance mechanism. FIG. 7A is an external oblique view of the head cap shown partially in section with the inside omitted, and FIG. 7B is a section view seen from inside the head cap shown partially in section. FIG. 8 is an oblique view describing operation of the head maintenance mechanism, and FIG. 9 is a front view describing operation of the head maintenance mechanism.

As shown in FIG. 5 and FIG. 6, the head maintenance mechanism 81 has a head capping mechanism 101 and a wiper mechanism 102. The head capping mechanism 101 is for sealing the nozzle surface 61*a* of the inkjet head 61, and the wiper mechanism 102 is for wiping the nozzle surface 61*a*.

The head capping mechanism 101 has a cap slider 111. The cap slider 111 is container-shaped, and can slide in the directions to and away from the nozzle surface 61*a* of the inkjet head 61.

A cap holder 112 is held in the recessed top part of the cap slider 111 so that the cap holder 112 can move in and out of the cap slider 111. The head cap 82 is affixed to the distal end part of the cap holder 112.

As shown in FIG. 7A and FIG. 7B, the head cap 82 is box-shaped with an opening of a size enabling sealing the nozzle surface 61*a*, with the inside of the head cap 82 rendering a storage recess 90.

The head cap 82 includes a case 91 made of hard plastic, for example, and a lip 92 that is made of a flexible elastomer and is disposed to the wall that forms the storage recess 90 of the case 91. The lip 92 is rendered in unison with the case 91 by means of a double-shot molding process. In this case the case 91 is injection molded in a first step, and the lip 92 is then injection molded from a thermoplastic elastomer in the second step. The lip 92 has an inside slope 93 and an outside slope 94 rendered on the front and back side of the peak 92*a* at the distal end, and when seen in section tapers gradually towards the nozzle surface 61*a* to a narrow point. When the head cap 82 approaches the inkjet head 61, the near end portion of the lip 92 including the peak 92*a* goes tight to the nozzle surface 61*a*.

The inside slope 93 of the lip 92 is formed as a smooth part 93*a* with low surface roughness. The outside slope 94 has a smooth part 94*a* with low surface roughness and a coarse part 94*b* with high surface roughness. The smooth part 94*a* is formed in the upper portion of the outside slope 94 from the peak 92*a* to about halfway down from the distal end, and the coarse part 94*b* is formed in the lower half separated from the peak 92*a*. The smooth parts 93*a* and 94*a* of the inside slope 93 and outside slope 94 of the lip 92 are rendered with a surface roughness Ra of 2.20 by rendering the corresponding surfaces of the die for molding the lip 92 with a surface roughness Ra of 0.068. The coarse part 94*b* of the outside slope 94 of the lip 92 is rendered with a surface roughness Ra of 4.34 by increasing the surface roughness of the corresponding surface of the die for molding the lip 92 to 1.358 Ra.

Because the surface roughness of the smooth parts 93*a* and 94*a* is low, the surface tension of the ink reduces the contact angle of the ink if ink clings to the smooth part. As a result, if ink gets on smooth part 93*a* or 94*a*, the effect of gravity causes the ink to easily move down, and the chance of ink moving upward to the peak 92*a* or remaining on the smooth part is reduced.

A multiple layer absorption member 95 for absorbing waste ink in the storage recess 90 is held in the head cap 82. The absorption member 95 is held by a pressure member 96, and the top surface of the absorption member 95 is positioned below the distal end position of the lip 92.

As shown in FIG. 4, a tube 84 is connected to the head cap 82, and when the carriage 62 is in the standby position and the lip 92 of the head cap 82 is tight against the nozzle surface 61*a*, a waste ink suction pump 83 can be driven to lower the pressure inside the head cap 82 and vacuum ink from the ink nozzles of the inkjet head 61. The waste ink that is removed from the nozzles travels through the tube 84 and is deposited into the waste ink absorption tank 85.

As shown in FIG. 5, the wiper mechanism 102 has a wiper 121, which is a flat rubber blade made of an elastic material. The wiper 121 is affixed to a wiper slider 122, which is supported movably to and away from the inkjet head 61 in a direction perpendicular to the direction of inkjet head 61 movement.

The wiper 121 can move between a wiping position and a retracted position by moving the wiper slider 122. As shown in FIG. 5, the wiping position is within the path of inkjet head 61 movement and the wiper 121 is moved to the wiping position during the wiping process for wiping ink and other contaminants from the nozzle surface 61*a*. As shown in FIG. 8, the wiper 121 is removed from the path of inkjet head 61 movement when in the retracted position.

As shown in FIG. 6, the wiper 121 is disposed with its distal end protruding distance s to the inkjet head 61 side from the nozzle surface 61*a*. As a result, when the wiper 121 is disposed to this wiping position and the inkjet head 61 is moved from the home position to the printing area, the wiper 121 rubs against the nozzle surface 61*a* of the inkjet head 61 as shown in FIG. 9, the nozzle surface 61*a* is wiped by the wiper 121, and ink and other foreign matter on the nozzle surface 61*a* is removed. Note that depending on the type of ink, the wiper 121 may be made from a soft plastic.

As shown in FIG. 5 and FIG. 8, the wiper mechanism 102 has an absorption member 123 disposed to the path of wiper 121 movement between the wiping position shown in FIG. 5 and the standby position shown in FIG. 8. When the wiper 121 slides while in contact with the absorption member 123, ink on the wiper 121 is wiped off by the absorption member 123.

Note that the cap slider 111 of the head capping mechanism 101 and the wiper slider 122 of the wiper mechanism 102 both slide as a result of driving the waste ink suction pump 83.

The label printer 11 cleans the inkjet head 61 by means of the head maintenance mechanism 81. This cleaning process is executed at predetermined times or when initiated by the user, and includes an ink suction cleaning operation in which the head cap 82 is set tight to the nozzle surface 61*a* of the inkjet head 61 and the waste ink suction pump 83 is driven to vacuum the inside and remove ink that has increased in viscosity from the ink nozzles of the inkjet head 61, and a wiping operation for wiping contamination from the nozzle surface 61*a* of the inkjet head 61 by means of the wiper 121.

The head maintenance mechanism 81 of the label printer 11 can also execute flushing and capping operations. The flushing operation discharges a predetermined amount of ink from the ink nozzles of the inkjet head 61 into the head cap 82 before printing starts or at a regular interval in order to maintain an appropriate ink meniscus in the ink nozzles of the inkjet head 61. The capping operation sets the head cap 82 tightly to the nozzle surface 61*a* of the inkjet head 61 in order to protect the nozzle surface 61*a* when not printing and prevent clogging of the ink nozzles as a result of evaporation.

Figure 10A:
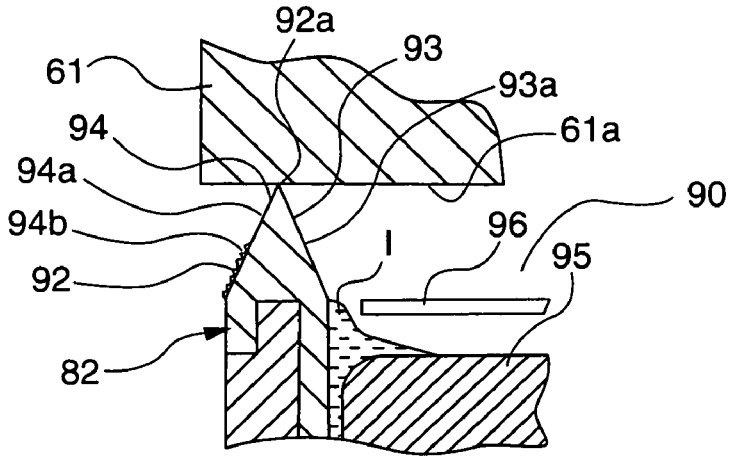
FIG. 10 describes adhesion of ink to the head cap according to the present invention, FIG. 10A to FIG. 10C being schematic section views of the head cap and the nozzle surface.

As shown in FIG. 10A, in a label printer 53 according to this embodiment of the invention, ink I absorbed by the absorbent material 95 in the storage recess 90 will not travel up along the inside slope 93 and rise to the peak 92*a* as a result of surface tension (capillary action) even if the head cap 82 is set tight against the nozzle surface 61*a* of the inkjet head 61 because the inside slope 93 at the lip 92 of the head cap 82 is a smooth part 93*a* with low surface roughness. As a result, adhesion of ink I where the peak 92*a* touches the nozzle surface 61*a* is substantially eliminated.

In addition, because the part of the outside slope 94 from the peak 92*a* down to the coarse part 94*b* is a smooth part 94*a* with low surface roughness, ink in the area of contact with the nozzle surface 61*a* moves easily downward, and leaving ink in this contact area is suppressed.

Figure 10B:
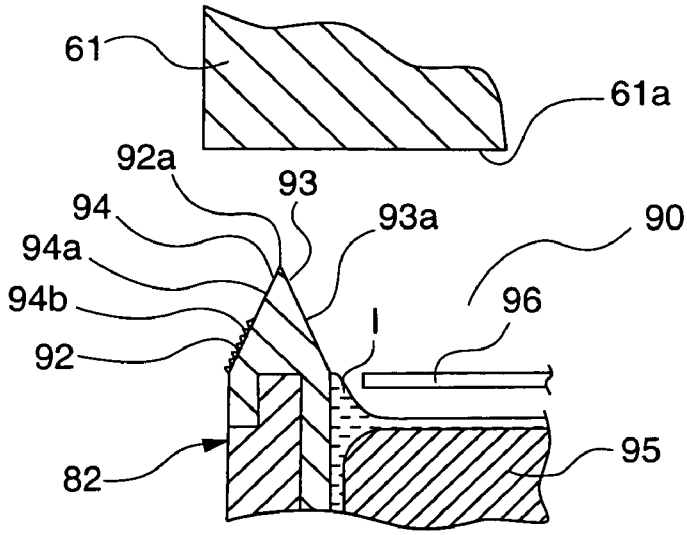

Therefore, as shown in FIG. 10B, the production of ink spray when the head cap 82 separates from the nozzle surface 61*a* is eliminated and ink is prevented from adhering to the ink nozzles.

Figure 10C:
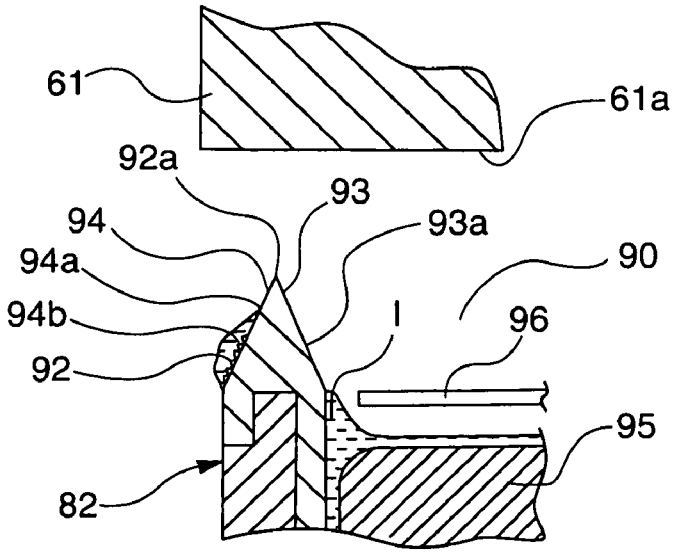

Furthermore, because a coarse part 94*b* is formed on the outside slope 94 separated from the peak 92*a*, even if some ink I is left in the area of contact between the lip 92 of the head cap 82 and the nozzle surface 61*a*, the ink left in this contact area moves down through the smooth part 94*a* on the peak 92*a* and is drawn into the coarse part 94*b* of the outside slope 94 due to the strong surface tension effect of the coarse part 94*b* when the head cap 82 separates from the nozzle surface 61*a* as shown in FIG. 10C.

Because ink on the outside slope 94 is attracted by the coarse part 94*b* and collection of fluid on the smooth part 94*a* is thus suppressed, ink is prevented from spraying when the head cap 82 separates from the nozzle surface 61*a*, and ink I is prevented from clinging to the ink nozzles.

As a result of identifying that the condition of the ink I changes according to the surface roughness of the inside slope 93 at the lip 92 of the head cap 82, the relationship with surface roughness was further explored experimentally. The results of the tests are described next with reference to FIG. 11.

FIG. 11 shows the results of tests exploring the relationship between the surface roughness of the lip and the ink condition. As shown in the figure, when the surface roughness Ra of the inside slope 93 of the lip 92 is 4.3, ink I may migrate along the inside slope 93 to the peak 92*a* at the point of contact with the nozzle surface.

When the surface roughness Ra is in the range 3.6-4, the ink I may or may not migrate upward along the inside slope 93 depending on other conditions.

When the surface roughness Ra is less than or equal to 3.2, the ink I will not rise. It was thus concluded that the surface roughness of the smooth parts 94*a* is preferably less than or equal to 3.2 Ra.

The surface roughness Ra of the coarse part 94*b*, however, is preferably greater than or equal to 3.6, and it was confirmed that the effect of drawing fluid to the coarse part 94*b* of the outside slope 94 improves as the surface roughness rises.

Figure 12A:
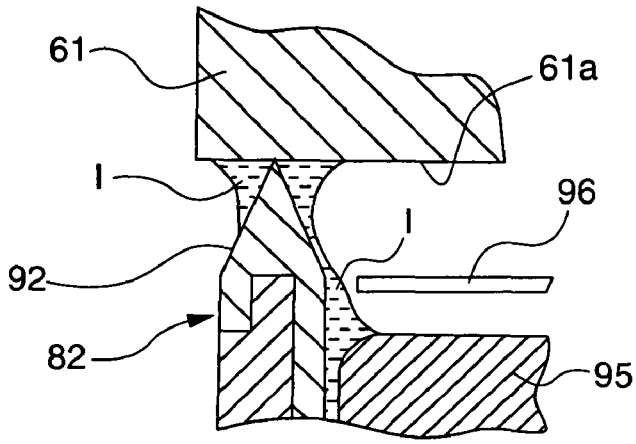
FIG. 12 describes the adhesion of ink in a head cap according to the related art, FIG. 12A to FIG. 12C being schematic section views of the head cap and the nozzle surface.

If the surface roughness of the inside slope 93 of the lip 92 is greater than or equal to 3.6 Ra, which is not smooth, ink I absorbed by the absorbent material 95 in the storage recess 90 will migrate along the inside slope 93 as a result of surface tension and rise to the area of contact with the nozzle surface 61*a* as shown in FIG. 12A.

Figure 12B:
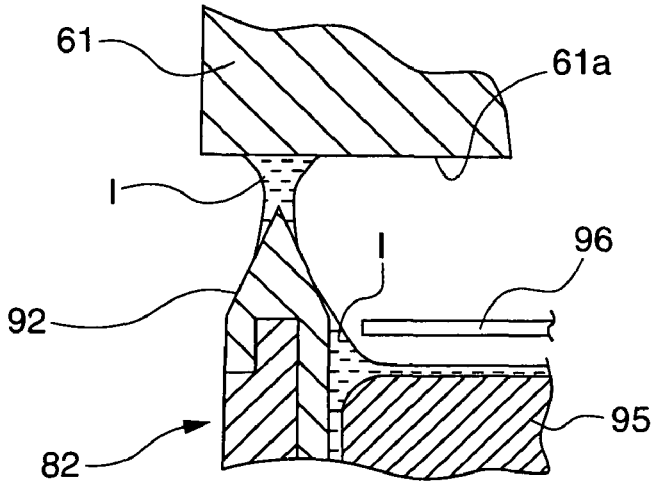
Figure 12C:
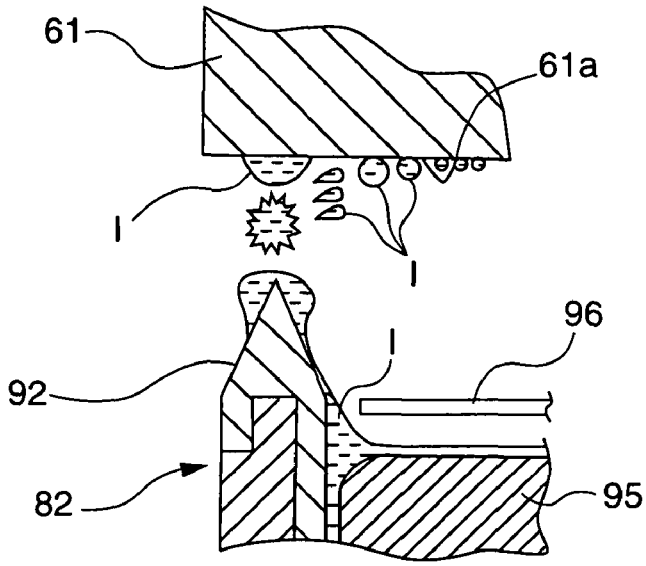

As a result, when the head cap 82 separates from the nozzle surface 61*a* as shown in FIG. 12B, a film of ink I is formed between the lip 92 and the nozzle surface 61*a*. When this film of ink I then breaks, the ink I scatters as shown in FIG. 12C and clings to the ink nozzles, resulting in deficient ink discharge from the ink nozzles.

Because the inside slope 93 of the lip 92 part of the head cap 82 is a smooth part 93*a* with a surface roughness Ra of 3.2 or less, ink I left on the lip 92 will not migrate up the inside slope 93 in this embodiment of the invention even if the head cap 82 is set tightly against the nozzle surface 61*a* of the inkjet head 61, and the adhesion of ink to the parts in contact with the nozzle surface 61*a* can be completely or substantially eliminated.

Production of ink spray when the head cap 82 separates from the nozzle surface 61*a* can thus be eliminated, discharge defects caused by ink on the ink nozzles can be prevented, and good ink discharge can be maintained.

The label side of flat print media M, such as CDs and DVDs, can thus be printed with high quality.

More particularly, because a coarse part 94*b* with higher surface roughness than the smooth part 94*a* near the peak 92*a* is rendered on a part of the outside slope 94 of the lip 92 separated from the nozzle surface 61*a*, if some ink is left in the area where the lip 92 of the head cap 82 contacts the nozzle surface 61*a*, the remaining ink is drawn by the surface tension effect to the coarse part 94*b* of the outside slope 94 when the head cap 82 separates from the nozzle surface 61*a*. Ink spray can thus be prevented, and the adhesion of ink on the ink nozzles can be better prevented.

The smooth parts 93*a* and 94*a* can be easily formed by polishing or otherwise reducing the surface roughness of the die used to mold the lip 92, and adhesion of ink on the ink nozzles can thus be prevented at low cost.

It will be obvious to one with ordinary skill in the related art that the invention is not limited to the foregoing embodiment and can be changed in many ways without departing from the scope of the accompanying claims.

For example, the inside slope 93 of the lip 92 is rendered as a smooth part 93*a* with low surface roughness, and the peak 92*a* and smooth part 94*a* of the outside slope 94 are rendered with the same surface roughness in the foregoing embodiment. However, ink I inside the head cap 82 is effectively prevented from moving to the contact area at the peak 92*a* even if a smooth part 93*a* with low surface roughness is rendered only on the inside slope 93, while additionally rendering a smooth part 94*a* on the peak 92*a* side of the outside slope 94 can further effectively reduce the amount of ink that tends to stay at the nozzle surface 61*a*.

In addition, an inside slope 93 and an outside slope 94 are rendered at the distal end side of the contact part of the lip 92. However, when a slope is rendered on only one side, whether the slope is on the inside circumference side or the slope is on the outside circumference side, the peak part is deflected to one side when the peak part (contact part) is pressed against the nozzle surface 61*a*. More particularly, if a slope is not rendered on the inside circumference side and a slope is rendered only on the outside side, the peak part is deflected to the inside, and if a slope is not rendered on the outside circumference side and a slope is rendered only on the inside side, the peak part is deflected to the outside. As a result, when the lip 92 then separates from the nozzle surface 61*a*, the peak returns to the original non-deflected position, and the chance of ink left at this contact part being sprayed increases. However, by rendering both an inside slope 93 and an outside slope 94 as in the embodiment described above, the peak 92*a* is simply pushed in and compressed, and ink I left at the contact part is not sprayed.

Furthermore, while the contact part may be a contact surface instead of a peak, a contact part that goes to a peak is preferable because less ink can be left at the contact area than when the contact part is a contact surface.

In addition, a coarse part 94*b* with higher surface roughness than the smooth part 94*a* on the peak 92*a* side is rendered on the outside slope 94 of the lip 92 at a position removed from the peak 92*a*. The smooth part 94*a* may be rendered only where ink can remain easily at the peak 92*a*, but rendering the smooth part 94*a* around the entire outside circumference is preferable because orientation is not required for installation and quality control is easier.

In addition, the surface roughness of the smooth parts on the inside and outside surfaces is the same in the foregoing embodiment, but the respective surface roughness may differ as long as the surface roughness is less than or equal to a centerline average surface roughness Ra of 3.2. The same surface roughness is preferable, however, because of the simplicity and ease of quality control and managing the dies used to mold the lip part.

The foregoing is described using a label printer for printing on the label side of flat media by way of example, but the invention can obviously also be used in printers that print to paper.

The foregoing is also described using double-shot molding by way of example, but a lip 92 made of synthetic rubber may be affixed to the case 91 or rendered by insert molding. Double-shot molding is preferred, however, because of simple parts management and low cost.

The fluid discharge device of the invention may be used in inkjet printers as in the embodiment described above, but the invention is not so limited. More particularly, the fluid discharge device of the invention may be any fluid discharge device that uses a fluid discharge head to discharge a fluid, such as color agent discharge heads used for manufacturing color filters for liquid crystal displays, electrode material discharge heads used for electrode manufacture in organic electroluminescent displays and field emission displays (FED), and biomaterial discharge heads used in biochip manufacture. The fluid discharge device of the invention may also be used in other devices, such as reagent discharge devices used as precision pipettes.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A fluid discharge device comprising:

a discharge head that has a discharge nozzle for discharging fluid; and a head cap that has an opening that can seal a nozzle surface to which the discharge nozzle of the discharge head is disposed, and can contact the nozzle surface so that the discharge nozzle is covered;

the fluid discharge device rendered so that the head cap can move to and away from the nozzle surface;

the head cap having a lip part that has a contact portion that contacts the nozzle surface; and an inside circumference surface of the lip part being formed with a centerline average surface roughness Ra of 3.2 or less.

2. The fluid discharge device described in claim 1, wherein:

the contact portion and outside circumference surface of the lip part being formed with a centerline average surface roughness Ra of 3.2 or less.

3. The fluid discharge device described in claim 1, wherein:

a coarse part with coarser surface roughness than the surface roughness of the contact portion is formed to a part of an outside circumference surface separated from the contact portion.

4. The fluid discharge device described in claim 2, wherein:

the inside circumference surface of the lip part is formed with an inside slope that tapers with gradually decreasing wall thickness toward a peak part of the contact portion to a point when seen in section, and the outside circumference surface of the lip part is formed with an outside slope that tapers with gradually decreasing wall thickness toward the peak part of the contact portion to a point when seen in section.

5. The fluid discharge device described in claim 1, wherein:

an inside circumference surface or the outside circumference surface of the lip part is formed by reducing the surface roughness of a die used to mold the lip part.

6. A printer that has the fluid discharge device described in claim 1; and prints on a print medium by discharging ink droplets from the discharge nozzle.

7. A media processing device that applies an information process to flat media, comprising:

the printer described in claim 6 for printing on the media.

* * * * *